United States Patent [19]

Altenbokum et al.

[11] 3,992,962

[45] Nov. 23, 1976

[54] DRIVING TRAIN FOR STRAIGHTENING ROLLS

[75] Inventors: Karlheinz Altenbokum; Klaus Hansgen, both of Witten, Germany

[73] Assignee: Mannesmann Aktiengesellschaft, Dusseldorf, Germany

[22] Filed: Nov. 18, 1974

[21] Appl. No.: 524,678

[30] Foreign Application Priority Data

Nov. 23, 1973 Germany ..... 2359039

[52] U.S. Cl. ..... 74/421 R

[51] Int. Cl.[2] ..... F16H 1/12; F16H 1/20

[58] Field of Search ..... 74/414, 421 R, 665 A, 74/665 F, 665 G; 101/175, 174

[56] References Cited

UNITED STATES PATENTS

| | | | |
|---|---|---|---|
| 342,664 | 5/1886 | Whitney | 74/421 R |
| 2,041,730 | 5/1936 | Shickman et al. | 101/175 |
| 2,126,486 | 8/1938 | Malkin | 74/421 R |
| 2,288,174 | 6/1942 | Wood et al. | 101/176 |
| 2,946,232 | 7/1960 | Jones | 74/421 R X |

*Primary Examiner*—Leonard H. Gerin
*Attorney, Agent, or Firm*—Ralf H. Siegemund

[57] ABSTRACT

The rolls in a straightening machine are arranged in an upper and a lower row each being associated with a gear, and these gears establish groups of three wherein one gear pertains to one row and drives the two others pertaining to the respective other row. The one gear of each group is on a shaft that is driven by a larger gear and these larger gears are correspondingly arranged in two rows. One of these larger gears receives driving input through a speed reducing gear from a drive motor, and meshes two of the larger gears but of the respective other row. A bypass gear drivingly links that one larger gear with a fourth one but being associated with the same row. The fourth and one of the two gears mesh with play.

3 Claims, 3 Drawing Figures

DRIVING TRAIN FOR STRAIGHTENING ROLLS

BACKGROUND OF THE INVENTION

The present invention relates to improvements in the driving train for straightening rolls arranged in an upper row and a lower row of the straightening machine.

Such a drive gear train has, on the one hand, a common input path, usually geared down for speed reduction from a relatively fast rotating motor; on the other hand, the drive gear train has a distributing portion to derive motive power for the several rolls from the common input. For this it is, for example, customary to associate each roll (with shaft) to an input gear and arrange them in groups of three, whereby one of the gears pertains to a roll of one of the rows and drives the two other gears of the group, both of which pertain to rolls of the other row.

Each of these roll drive gears, one per group, sits on a shaft which in turn is driven by a larger gear. These larger gears in turn are all interconnected and drivingly connect to the earlier mentioned common input path. For reasons of the physical arrangement of the rolls, these larger gears are also arranged in and along corresponding rows. As a consequence, some of these larger gears are driven directly by another one, others are driven by ones which in turn are driven by that other one. It was found, however, that this arrangement results in a rather unfavorable, nonuniform load distribution among these larger gears. In cases, the one larger gear whose shaft is the output of the common train portion has to transmit twice the actually needed power.

DESCRIPTION OF THE INVENTION

It is an object of the present invention to improve the construction of the drive gear train for straightening rolls and here particularly the power distribution portion as leading from the common path to the three-gear groups as defined above, without having to modify substantially the overall arrangement.

It is another object of the present invention to reduce the power needed to drive the rolls in a straightening machine.

In accordance with the preferred embodiment of the invention, the improvement involves specifically the relation among the plurality of (large) gears, each of which sits on a shaft that drives the respective drive gear of a three gear - three roll driving group. A first one of these larger (or secondary) gears sits on the output shaft of the common path of the overall drive gear train, and two others of the secondary gears mesh directly the first one for being driven therefrom. A fourth one of these secondary gears is drivingly connected to the first one, but via an additional gear which serves only as such transmission element and is not one of the secondary gears. The fourth gear and one of the two others mesh with play without power transmission so that the spatial arrangement of gears along the roll path remains substantially uniform.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows an upper row of gears which are gears 17, 18, 19, 20 and 21 and a lower row of gears 22, 23, 24, 25, 26 (and one undesignated gear of similar diameter ahead of gear 22; another gear may be provided ahead of gear 17). Each of these gears sits on a shaft for driving a roll in a straightening mill so that there are provided an upper row and a lower row of such rolls. The purpose of the drive train as shown in the Figures, is to drive these rolls. The dimensions and position determine the requirements for the rolls. The arrows are representative of the direction of rotation.

Figure 1:
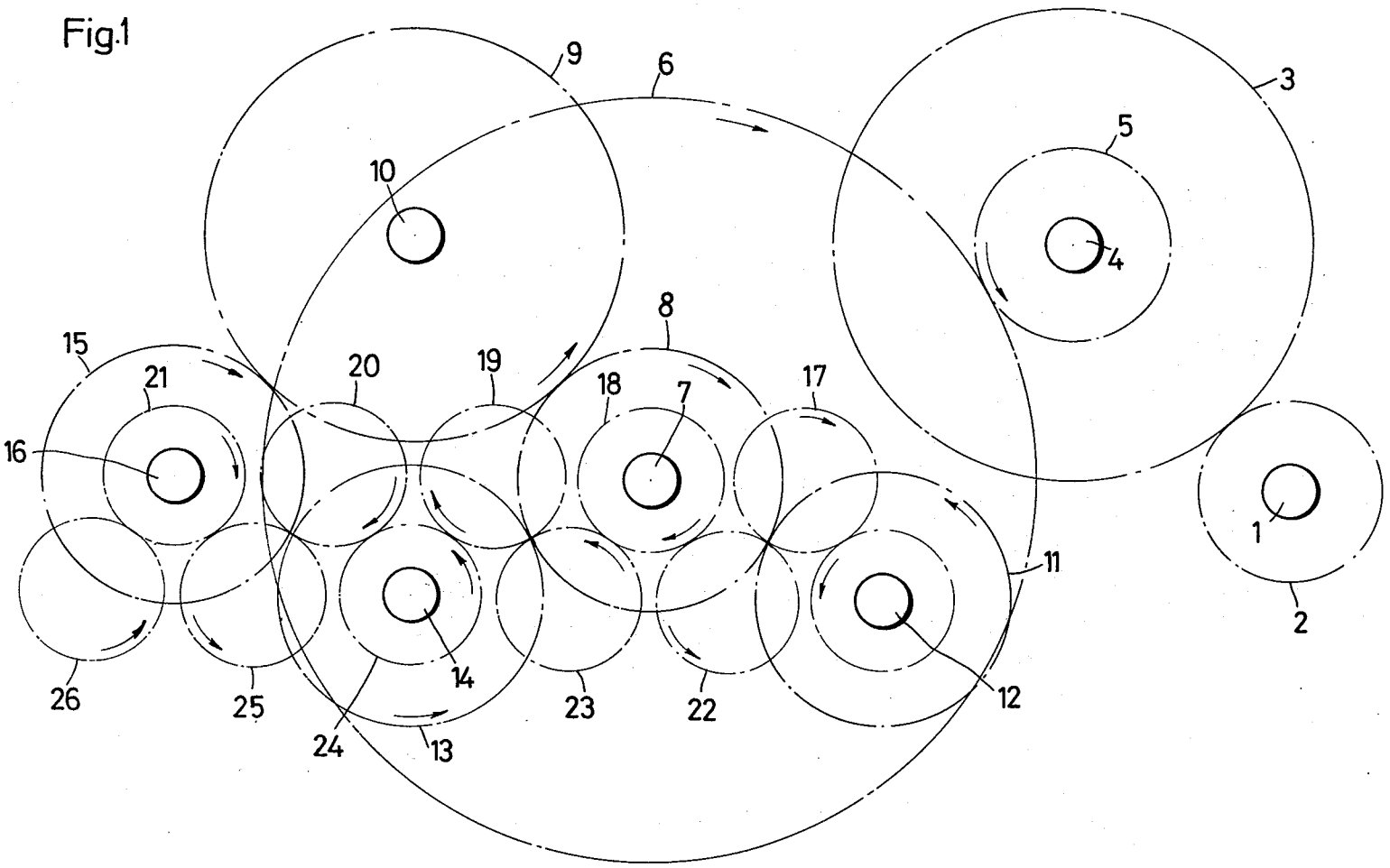
FIG. 1 is a somewhat simplified illustration of a drive train for driving the rolls in a straightening machine in accordance with the preferred embodiment of the invention.

These immediate roll driving gears are arranged in groups of three, wherein two of the three of a group pertain to the same row, the third one to the other row, whereby this latter one drives the two others of the group. For example, gears 21, 25, 26 constitute a first group whereby upper row gear 21 meshes with and drives lower row gears 25 and 26.

A second group is established by the two upper row gears 19 and 20, and they are being driven by the third one of the group, which is the lower row gear 24. Additionally, the two groups are linked in that gear 20 meshes with gear 25, but with play, i.e., without transfer of torque.

Gears 18, 22, 23 constitute a third group wherein the upper row gear 18 drives the two others, and gears 23 and 19 may mesh with play.

Figure 3:
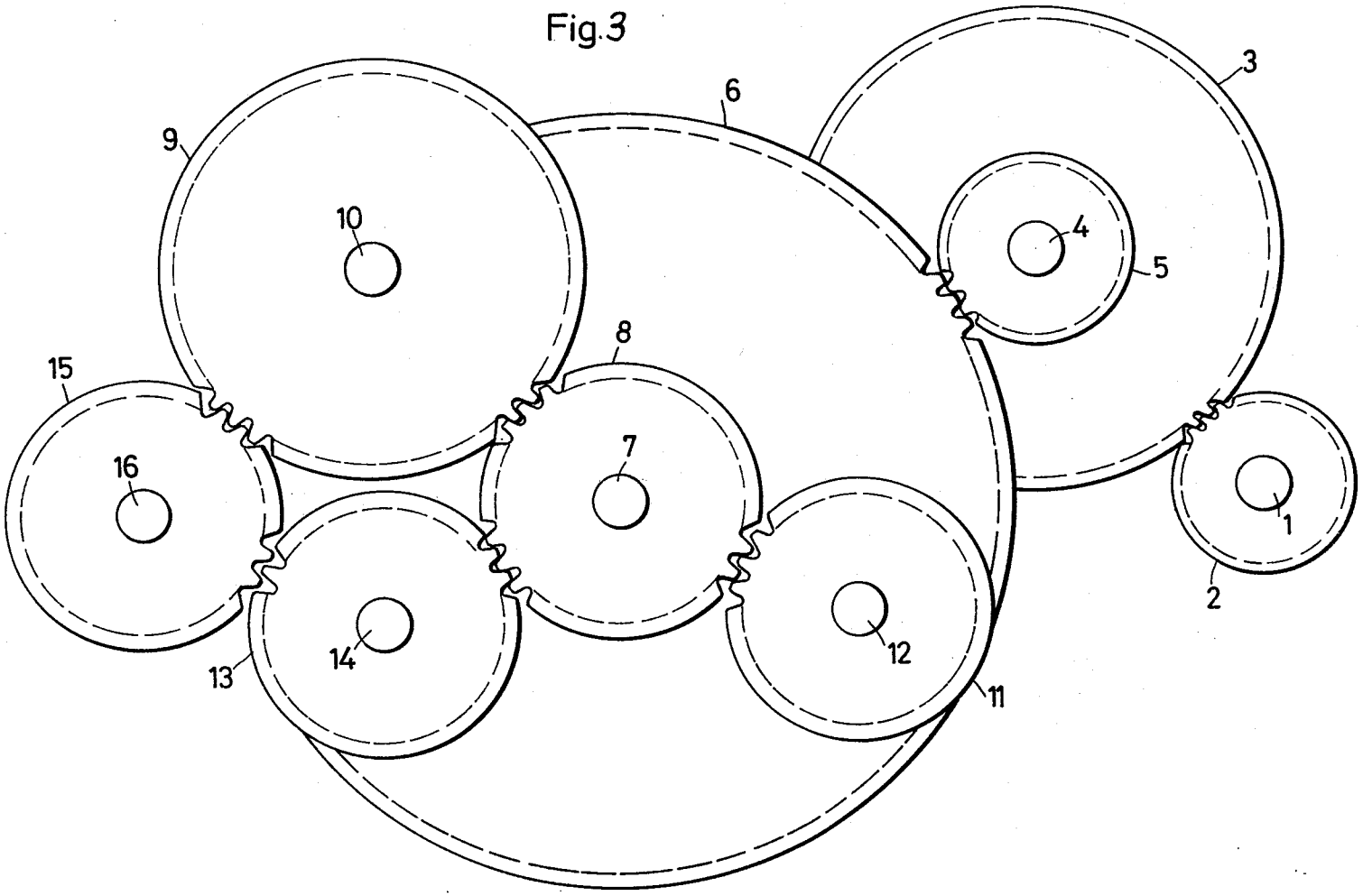
FIG. 3 is a more complete illustration of the drive train.

All these gears are driven by the following drive train. FIGS. 1 and 3 show a drive shaft 1 which is driven by a suitable motor (not shown) as prime source of motive power and torque. Shaft 1 carries a pinion 2 meshing with a gear 3 for driving same. Gear 3 is mounted on a shaft 4 which carries a pinion 5 driving a gear 6. Large gear 6 sits on a shaft 7, which can be considered the output of the common speed reducer portion in the gear train.

Shaft 7 now carries another gear 8 meshing with three gears 9, 11 and 13. Gear 9 on shaft 10 meshes with a gear 15 on a shaft 16. The two gears 11 and 13 sit respectively on shafts 12 and 14. Power is taken from the gear train via shafts 7, 12, 14 and 16 which are arranged in two rows, shafts 7 and 16 pertaining to one row, shafts 12 and 14 pertain to the other row. This arrangement of gears and shafts in rows follows the arrangement of roll drive gears in rows. Moreover, shafts 7, 14 and 16 each drive one roll drive gear, 18, 24, 21 respectively of and in the three, three-gear groups introduced above. Shaft 12 drives the not designated roll drive gear of the fourth group.

In other words, those gears (which could be termed secondary gears) on and for driving the respective shafts (7, 12, 14, 16) which carry the respective roll drive gear for one 3-gear group, are arranged following the upper and lower row grouping. Thus, secondary gears 8 and 15 are provided for those shafts (7 and 16) for driving upper row gear drives of some (e.g., half) of the three-gear groups, as introduced above, while secondary gears 11 and 13 are provided for those shafts (12, 14) which drive lower row gear drives of the remaining three-gear groups.

Figure 2:
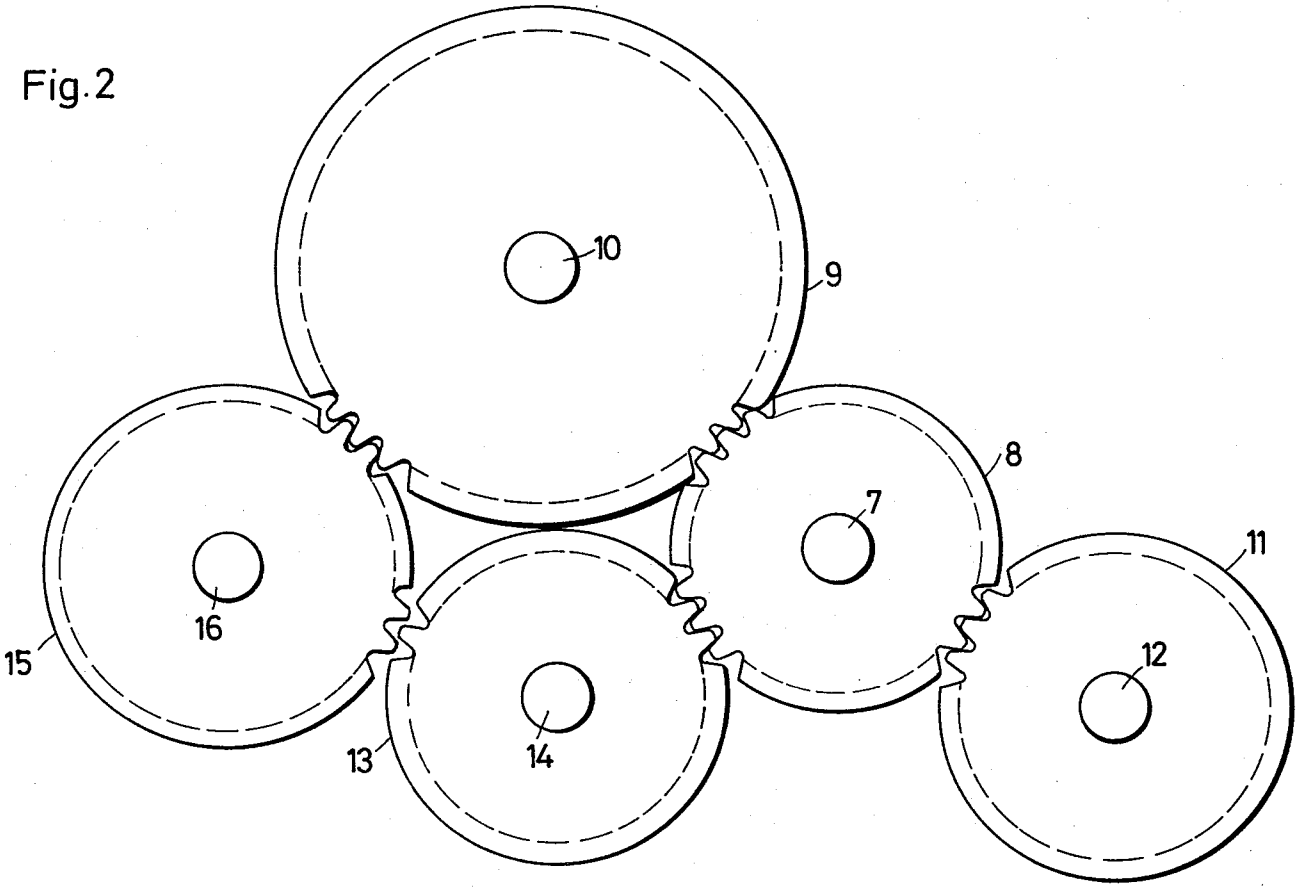
FIG. 2 is a portion of FIG. 1.

As one can see, shafts 12 and 14 of lower row secondary gears 11 and 13 are directly driven by meshing with upper row secondary gear 8 on shaft 7 (which in turn is driven via 6 - 5 - 3 - 2 - 1). Shaft 16 of upper row secondary gear 15 however is not driven via gear 13 but via a gear outside of the group of secondary gears, namely through gear 9, being driven by gear 8 and driving in turn gear 15. Gears 13 and 15 mesh without engagement of the teeth. This play is overaccentuated in FIGS. 1 and 2.

The chosen path of torque and power transmission reduces the power transfer from 8 to 15 to half the value a direct transmission of power from 13 to 15 would require. As a consequence, tooth shape and width can be the same in all secondary gears 11, 8, 13, 15, and for example, gears 8, 13, 15 will not have to have larger teeth than 11. If gear 9 were not provided for, all gears had to be rated and designed corresponding to gear 8, i.e. gears 11, 13 and 15 had to be oversized. The bypass 9 obviates that need.

The play between gears 13 and 15 requires only very little change in the axial distances so that the geometry of the arrangement remains essentially regular. That arrangement is dictated by the regularity of roll spacing and arrangement which in turn dictates the gear grouping which in turn results in the row arrangement of secondary gears 8, 11, 13 and 15. Very little redesigning is needed as compared with an arrangement wherein gear 13 would actually drive gear 15.

It can also be seen, that for a longer roll path another upper row secondary gear would mesh with play with gear 11 and driven by another bypass gear which in turn meshes with gear 8.

The invention is not limited to the embodiments described above but all changes and modifications thereof not constituting departures from the spirit and scope of the invention are intended to be included.

We claim:

1. In a drive train for the rolls of a straightening machine arranged in an upper and a lower row and wherein each roll is driven by a gear, these gears being arranged in groups of three, wherein each group pertains to one such group only, and one gear of any of said groups pertains to a roll of one of the rows and the other two gears of the same group pertain to rolls of the other row, and wherein the one gear of a group of the groups is shaft driven by a larger gear, there being a plurality of such larger gears accordingly, as many as there are groups, the drive train further including input drive means for driving a shaft, the improvement comprising:

a first one of the gears of the plurality being on said shaft, and one gear of a first group of the groups whose one gear pertains to a roll of a particular row, being also on said shaft and being shaft driven accordingly;

two further gears of the plurality meshing with and being driven by the first gear and shaft-driving one gear each respectively of two different groups of the groups whose respective one gear each pertains to a roll of the respective other row for both said different groups;

a fourth gear of the plurality meshing with play with one of the further gears and shaft-driving one gear of a group of the groups, different from said first and said two groups, and whose one gear pertains to a roll of the particular row; and a fifth gear, not pertaining to the plurality and meshing with the first and fourth gears for drivingly interconnecting them.

2. In a drive train as in claim 1, wherein said gears of the plurality are similar in size and dimension.

3. In a drive train as in claim 1, wherein the fifth gear is larger in diameter than the gears of the plurality.

* * * * *

UNITED STATES PATENT OFFICE

CERTIFICATE OF CORRECTION

Patent No. 3,992,962 Dated November 23, 1976

Inventor(s) Karlheinz Altenbokum et al. Page 1 of 2

It is certified that error appears in the above-identified patent and that said Letters Patent are hereby corrected as shown below:

On the cover page, the illustrative figure should appear as shown on the attached sheet.

Signed and Sealed this

Twenty-second Day of February 1977

[SEAL]

*Attest:*

RUTH C. MASON
*Attesting Officer*

C. MARSHALL DANN
*Commissioner of Patents and Trademarks*

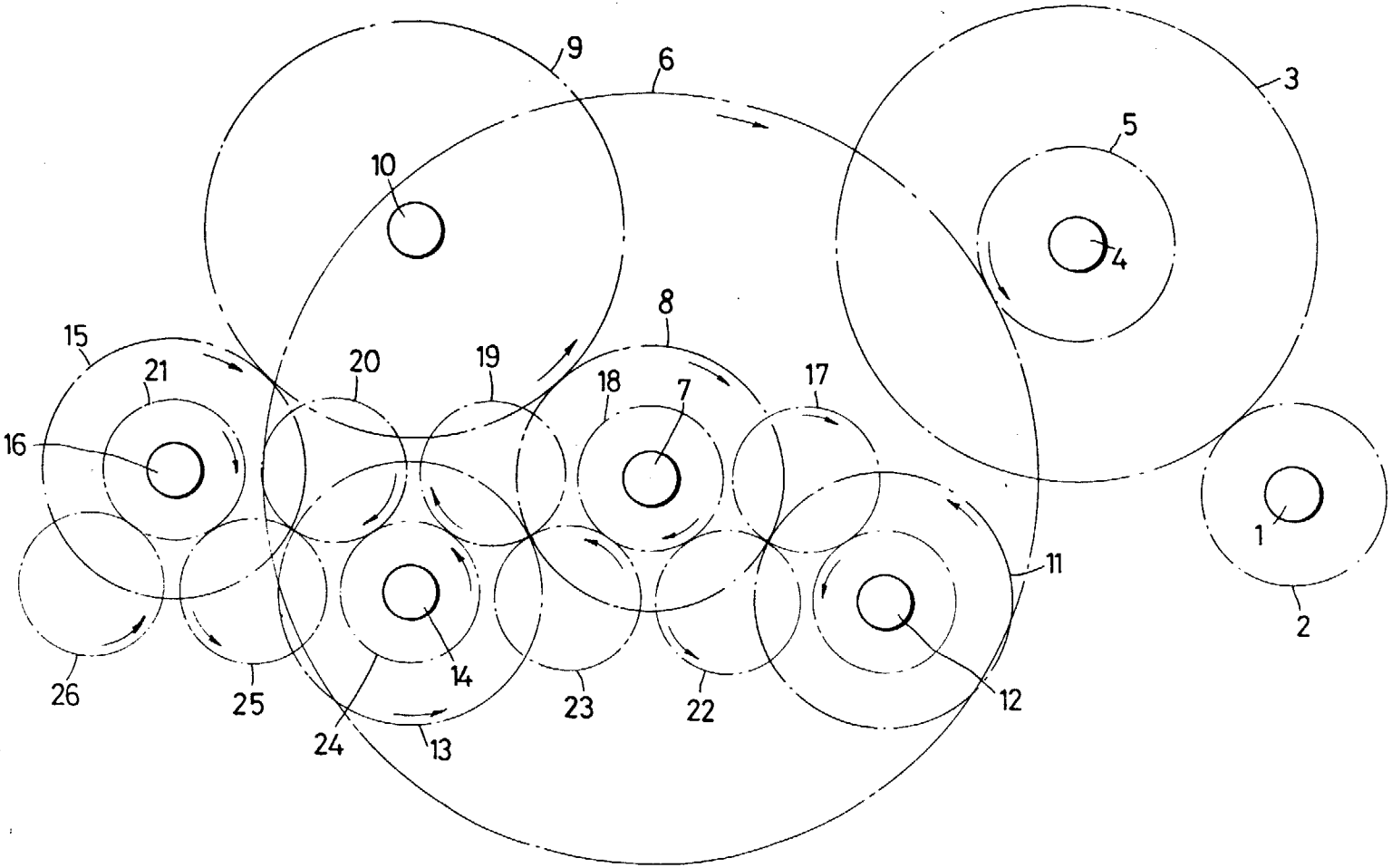
1
2
3
4
5
6
7
8
9
10
11
12
13
14
15
16
17
18
19
20
21
22
23
24
25
26